United States Patent [19]

Eichinger

[11] 4,265,625

[45] May 5, 1981

[54] Z-DRIVE FOR WATERCRAFTS

[75] Inventor: Johann Eichinger, Vaterstetten, Fed. Rep. of Germany

[73] Assignee: Carl Hurth Maschinen-und Zahnradfabrik, Munich, Fed. Rep. of Germany

[21] Appl. No.: 971,731

[22] Filed: Dec. 22, 1978

[30] Foreign Application Priority Data

Jan. 20, 1978 [DE] Fed. Rep. of Germany ..... 2802541

[51] Int. Cl.[3] ..... B63H 5/12

[52] U.S. Cl. ..... 440/53; 440/75

[58] Field of Search ..... 115/34 R, 34 B, 34 C, 115/35, 37, 41 R, 34 HT; 440/49, 53, 55–63, 75

[56] References Cited

U.S. PATENT DOCUMENTS

| | | | |
|---|---|---|---|
| 3,534,703 | 10/1970 | Ekman | 115/35 |
| 3,847,108 | 11/1974 | Shimanckas | 115/35 |
| 3,888,203 | 6/1975 | Lohse | 115/35 |
| 3,954,083 | 5/1976 | Frostrom | 115/41 R |

FOREIGN PATENT DOCUMENTS

| | | | |
|---|---|---|---|
| 995658 | 6/1965 | United Kingdom | 115/35 |

*Primary Examiner*—Trygve M. Blix
*Assistant Examiner*—Jesus D. Sotelo
*Attorney, Agent, or Firm*—Blanchard, Flynn, Thiel, Boutell & Tanis

[57] ABSTRACT

A lid for an upper housing part enclosing a part of a Z-drive for watercrafts. A removal of the lid provides access to an articulated joint coupling to an input shaft to the upper housing part to the output of a drive motor mounted inboard of the watercraft. The lid extends over the entirety of the upper housing part such that its removal provides good access to the articulated coupling and other components within the upper housing part.

6 Claims, 5 Drawing Figures

Z-DRIVE FOR WATERCRAFTS

FIELD OF THE INVENTION

The invention relates to a lid for a housing for part of a Z-drive for watercrafts, in particular boats and yachts, in which part is provided a joint connection to an inboard mounted motor which is pivotally suspended in two planes at the rear of the boat, and which transmits the motor performance through a Z-shaped drive train having a bevel gear reversing mechanism and a simple pair of bevel gears onto a propeller which extends below the waterline.

BACKGROUND OF THE INVENTION

In such drives the joint connection is usually protected in the length of shafting between the motor and the gearing with a bellows preventing penetration of water and dirt. The bellows in turn is at least partly surrounded by a bell-shaped lug which starts out from the upper housing part of the Z-drive in order to reduce the danger of damage.

This lug is constructed in one piece with the upper housing part in U.S. Pat. No. 3,888,203. A similar construction, in which, however, the bell-shaped protective part is secured, is shown in U.S. Pat. No. 3,893,407. In both cases, the installation and the service of the joint connection and the bellows is made more difficult by the bell.

A modified construction is known from German OS No. 19 33 176: A spherical cup-shaped cover is swingably supported upwardly with the Z-drive on the same axis and can be swung upwardly also by itself after loosening of a screw, which causes the bellows or the joint connection to become accessible. The constructive input for the upwardly swingable cover is considered here as disadvantageous.

Therefore, the basic purpose of the invention is to provide a simple and effective cover for the joint connection or for the bellows which surrounds said joint connection.

To attain the purpose, a lid is mounted onto the upper housing part and projects forwardly over the actual gear box so far that it covers in upward direction the joint connection or the bellows surrounding it, while for the protection to the sides two platelike lugs, which start out from the upper housing part, are provided on which lugs rests the lid at the same time. This lid closes off at the same time an opening which exists in the upper housing part for manufacture and installation reasons and can replace a lid which would also otherwise be provided for it. It may be simpler from a technical casting standpoint to mount the platelike lugs not on the housing, but on the part of the lid which projects over the joint connection. After removing the lid the joint is in this construction accessible from all sides.

It is generally common to keep the outer contours of a Z-drive as free as possible from operating elements, lifting devices, etc. and to integrate these aggregates into the housing parts. Therefore, the invention is further developed in a manner that the mentioned lid covers the parts for the reversing mechanism, which mechanism is mounted on the upper housing part or the cover, and the projecting handle of the oil dip-stick, etc.

A solution for this which aids the aesthetics of today is realized by designing the upper housing part and the lid in such a manner that both form a closed unit.

Z-drives have already become known in which the operating lever which is mounted on the upper housing part and the oil dip-stick are enclosed with a separate cover. However, in this construction the cover of the joint connection is cast on the upper housing part and a vertical surface must be machined on top of the housing part before the placement of the lid thereon, which lid then forms the closed unit, for which it here needs also a machined surface. These additional machining operations are not needed in a Z-drive according to the invention, which moreover offers also a better accessibility to the joint connection in the drive train between the motor and the Z-drive.

BRIEF DESCRIPTION OF THE DRAWINGS

The invention will be described hereinafter with reference to FIGS. 1 to 4.

DETAILED DESCRIPTION

Figure 1:
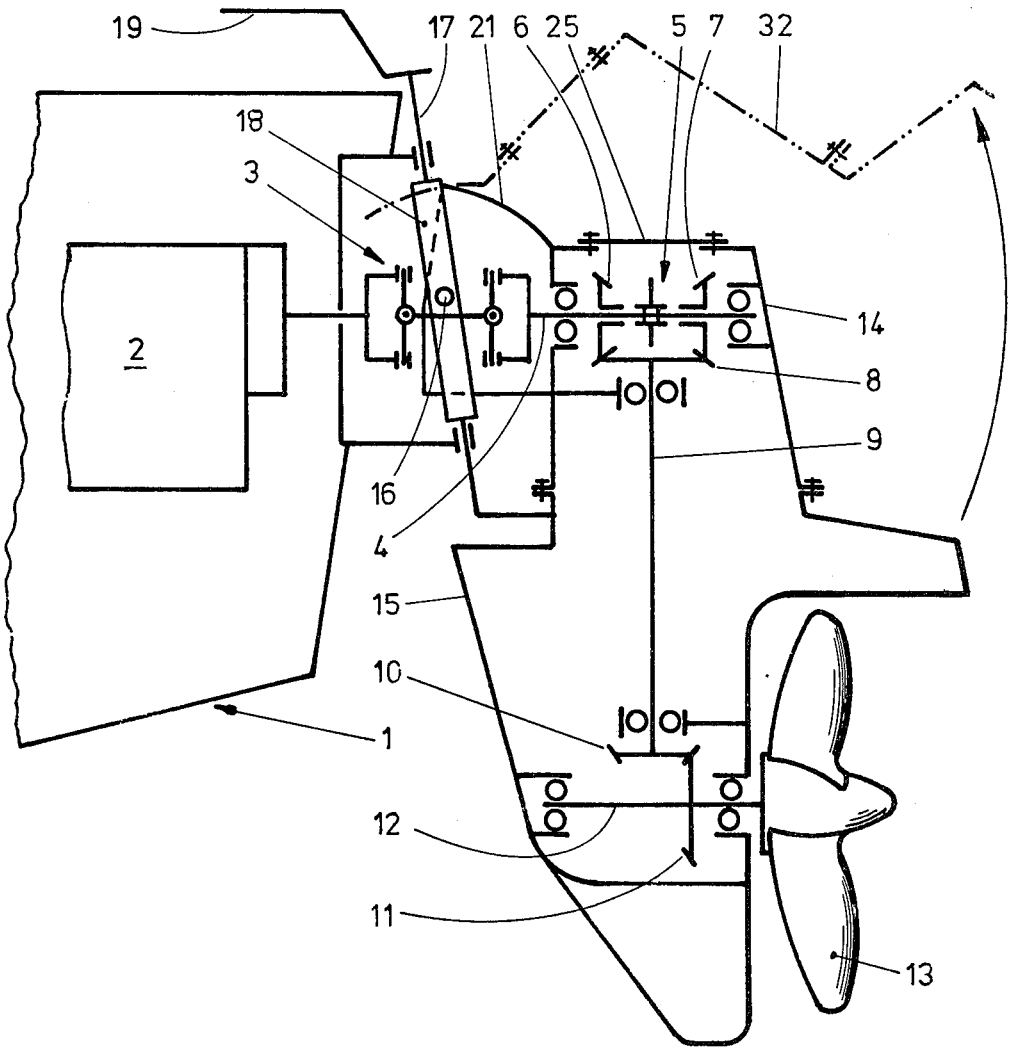
FIG. 1 schematically illustrates a Z-drive, to which the invention can be applied.

A motor 2 which is mounted in the hull of a watercraft 1 and has an output shaft which is connected in series to a universal joint construction 3, a substantially horizontal drive shaft 4, a reversing gear mechanism 5 having two bevel drive gears 6, 7, which can be selectively coupled with the drive shaft 4 and which engage a common driven bevel gear 8 having a vertical shaft 9 secured thereto. The shaft 9 is connected through a pair of bevel gears 10, 11 to a substantially horizontal propeller shaft 12, on which the propeller 13 is mounted and rotatable therewith.

The drive shaft 4 is rotatably supported on an upper housing part 14. The propeller shaft 12 is rotatably supported in a lower housing part 15. The vertical shaft 9 extends between the upper and lower housing parts and is rotatably supported in both. The Z-drive which is formed by the series connected drive components in the two secured together housing parts 14, 15 is pivotal in a universal joint ring 18 or the like which is pivotally mounted at the rear of the watercraft about a horizontal axis 16 for the purpose of facilitating a trimming and lifting of the lower housing part upwardly out of the water. The universal joint ring 18 is also pivotal to both sides about a generally vertically extending axis 17 which is inclined at a small angle with respect to the vertical for the purpose of facilitating a steering of the lower housing part through a lever 19. The devices which are needed for tilting are known for example from U.S. Pat. No. 4,137,862, and do not need to be described here. They are also not illustrated herein.

The universal joint construction 3 is surrounded by a bellows 20 to protect the joint construction 3 from water and dirt. The bellows is in turn protected against damage by a suitably formed cover 21, which is mounted on the upper housing part 14. This cover has in cross section the approximate shape of a U rotated at 180°.

Figure 2:
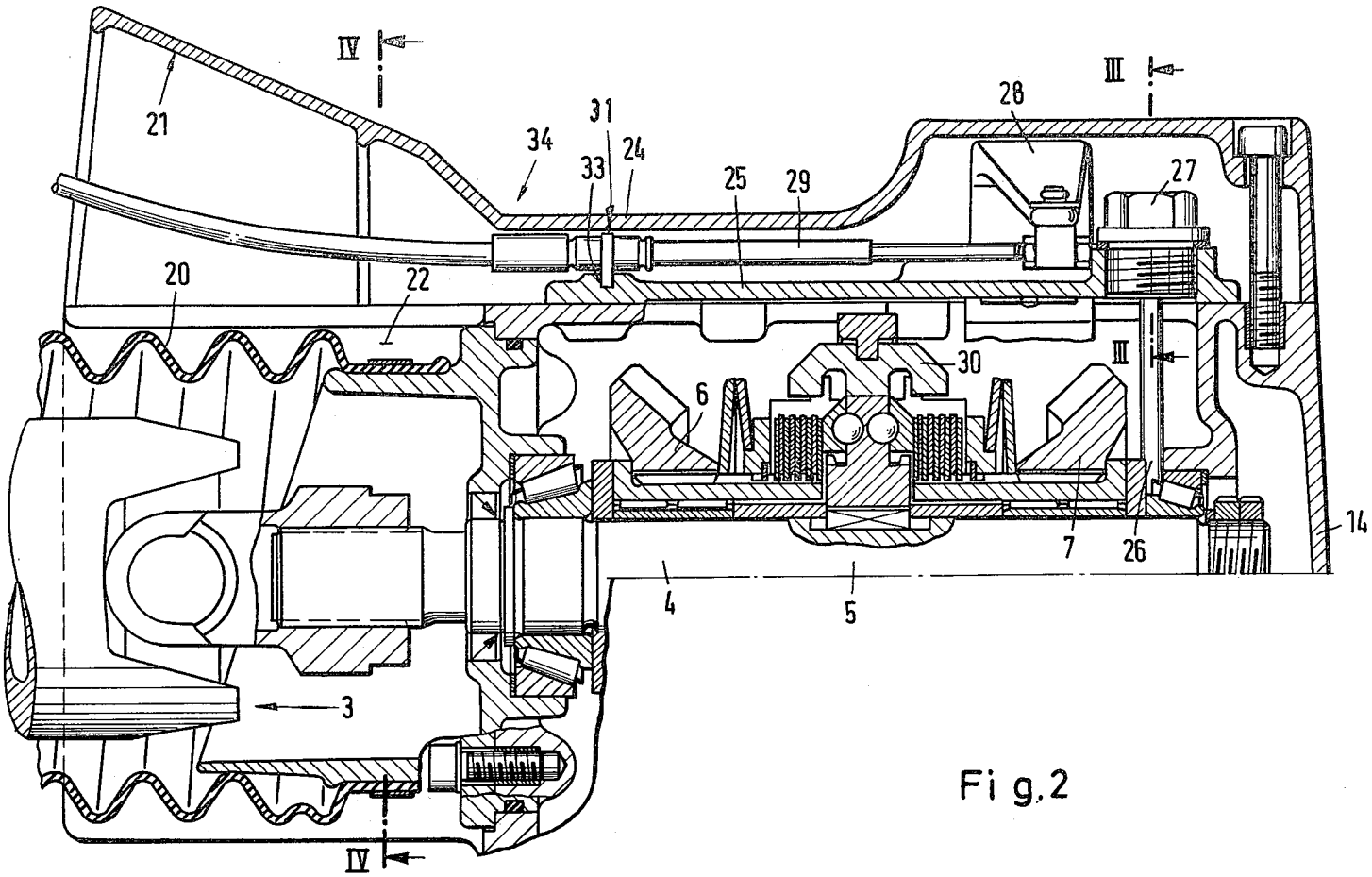
FIG. 2 is a sectional longitudinal view of the upper part of a Z-drive according to the invention.
Figure 4:
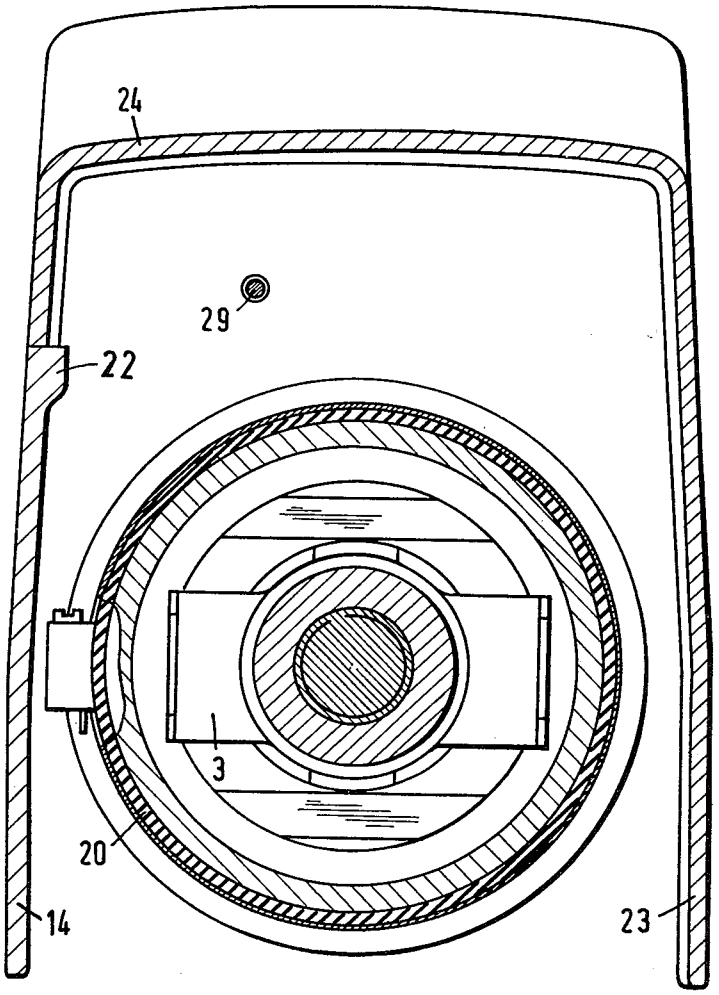
FIG. 4 is a cross-sectional view along the line IV–IV.

According to the invention, the cover 21 is divided (FIGS. 2 and 3): Only two platelike lugs 22 are mounted, preferably cast, on the upper housing part 14, on which lugs rests a lid 24 which is secured by screws to the upper housing part 14 and projects beyond same substantially as far as the plates are long. After removal of the lid, the bellows 20 and also the joint construction 3 are accessible for installation and service. As already mentioned, it is also possible to cast lugs 23 (FIG. 4) on the lid 24 as an extension of the sidewall and which do not provide a bearing surface or—accepting additional operations—a support on the front wall of the upper housing part 14. The accessibility of the joint construction is then still better in this design.

Figure 3:
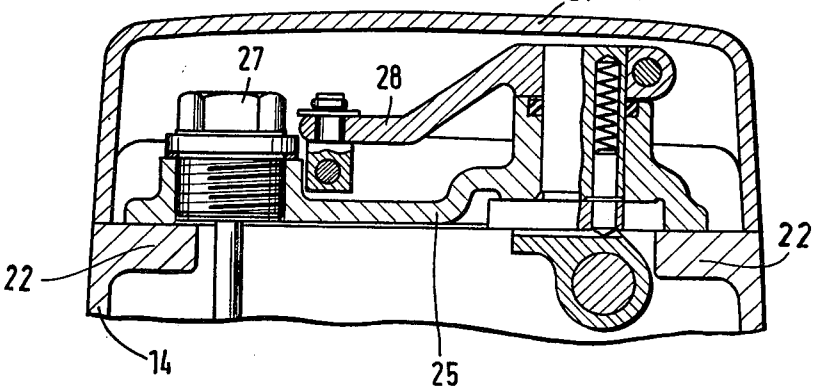
FIG. 3 is a cross-sectional view along the line III—III.

The upper chamber in the upper housing part 14 is always tightly closed with a cover 25, even when the lid 24 must be removed (FIG. 3).

An oil dip-stick 26 projects into the upper housing part 14 through the cover 25 which is secured thereon. The handle or screw plug 27 of the dip-stick 26 projects upwardly above the cover 25. An operating lever 28 or the like is arranged next to the screw plug, which operating lever is operated through a cable control 29 or the like and acts through a not shown linkage onto a gear-shift sleeve 30 of the reversing gear mechanism 5. These mechanisms 27, 28, 29 are covered in a very advantageous manner with the lid 24, which causes the entire Z-drive to have, with a suitable design of the lid, also an appealing outer appearance.

A holding plate 31 which is secured to the casing of the cable control 29 is received in a slot 33 which is provided in the upper housing part 14 or in the cover 25, which slot is covered above by the lid 24. Thus the lid 24 also performs a fastening function.

The cross-sectional reduction of the lid 24 at 34 is necessary, in order to achieve, during tilting up into the position which is identified by the reference numeral 32 in FIG. 1 and is illustrated with broken lines, a tilt angle which is as great as possible.

The invention is not to be limited to the use in a Z-drive according to FIG. 1. It can also be used accordingly in Z-drives without a reversing structure or those with a different reversing structure or in Z-drives having a different construction.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A Z-drive arrangement for watercrafts, comprising:

an inboard mounted engine having an output shaft;

an outboard mounted housing means located at the rear end of said watercraft and extending rearwardly therefrom and first means swingably suspending said housing means for movement about two orthogonally related axes located rearwardly of said rear end of said watercraft, said housing means including an upper housing part extending rearwardly from said rear end of said watercraft and a lower housing part, said lower housing part having a propeller shaft rotatably mounted therein, said upper housing part including second means defining an upwardly opening access opening extending generally the full horizontal length of said upper housing part;

drive means mounted in said housing means and including a first drive shaft extending parallel to said propeller shaft, a second drive shaft oriented at a right angle to said first shaft and said propeller shaft, a first angle drive means including means defining a reversing mechanism connecting said first and second drive shafts, and a second angle drive means connecting said second drive shaft and said propeller shaft, said first drive shaft and said first angle drive means being mounted in said upper housing part, said first drive shaft being connected through a universal joint means to said output shaft of said engine so that said first and second drive shafts and said propeller shaft and the interconnecting first and second angle drive means move together with said housing means about said orthogonally related axes, said universal joint means, said first drive shaft and said first angle drive means all being accessible through said access opening; and cover means removably secured across said access opening said cover means comprising a first cover covering said first drive shaft and said first angle drive means and a second cover covering said first cover and said universal joint means, wherein a handle of an oil dip-stick is provided adjacent said first cover, said second cover only covering said handle and wherein operating means for said reversing mechanism is also provided adjacent said first cover, said second cover only covering said operating means.

2. The Z-drive arrangement according to claim 1, wherein said cover means has in the area which covers said universal joint means laterally downwardly projecting wall means covering the sides of said universal joint means.

3. The Z-drive arrangement according to claim 1, wherein said cover means includes means also covering a handle of an oil dip-stick, said handle projecting outwardly from said upper housing part.

4. The Z-drive arrangement according to claim 1, wherein said upper housing part and said cover means form together a closed unit.

5. The Z-drive arrangement according to claim 1, wherein said access opening opens not only upwardly but also laterally in a direction perpendicular to the axis of rotation of said first drive shaft.

6. The Z-drive arrangement according to claim 1, wherein said reversing mechanism includes an operating lever and a control cable, wherein said access opening provides access to said operating lever and said control cable and wherein said second cover means includes means covering said operating lever and said control cable.

* * * * *